US009339922B2

(12) United States Patent
Schmidt et al.

(10) Patent No.: US 9,339,922 B2
(45) Date of Patent: May 17, 2016

(54) CRIMPING TOOL

(71) Applicant: UNITED TECHNOLOGIES CORPORATION, Farmington, CT (US)

(72) Inventors: Gregory C. Schmidt, Portland, CT (US); Patrick R. Carey, Durham, CT (US); Daniel F. Palmer, East Hampton, CT (US); John V. Marino, Preston, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 0 days.

(21) Appl. No.: 14/569,357

(22) Filed: Dec. 12, 2014

(65) Prior Publication Data

US 2015/0165570 A1 Jun. 18, 2015

Related U.S. Application Data

(60) Provisional application No. 61/915,866, filed on Dec. 13, 2013.

(51) Int. Cl.

| | |
|---|---|
| ***B25B 27/00*** | (2006.01) |
| ***H01R 43/042*** | (2006.01) |
| ***H01R 43/045*** | (2006.01) |
| ***H01R 43/048*** | (2006.01) |
| ***B25B 27/14*** | (2006.01) |

(52) U.S. Cl.

CPC ..... *B25B 27/14* (2013.01); *H01R 43/042* (2013.01); *H01R 43/045* (2013.01); *H01R 43/048* (2013.01); *Y10T 29/53717* (2015.01)

(58) Field of Classification Search

CPC ..... B23P 11/005; B25B 27/14; B25B 27/10; H01R 43/042; H01R 43/045; H01R 43/048; Y10T 29/53717

USPC ..... 29/243.5–243.58

See application file for complete search history.

(56) References Cited

U.S. PATENT DOCUMENTS

| | | | | | |
|---|---|---|---|---|---|
| 2,722,146 | A * | 11/1955 | Byrem | H01R 43/045 | 29/751 |
| 3,075,198 | A * | 1/1963 | Over | H01R 43/045 | 29/751 |
| 3,479,714 | A * | 11/1969 | Allsop | B25B 21/001 | 29/240 |
| 3,792,632 | A * | 2/1974 | Pinkerton | F16B 19/05 | 81/10 |
| 5,094,097 | A * | 3/1992 | Tooth | H01R 43/042 | 29/751 |
| 5,282,303 | A * | 2/1994 | Schriever | A41H 37/006 | 269/149 |
| 5,307,553 | A * | 5/1994 | Frohlich | H01R 43/045 | 29/566.2 |
| 5,887,469 | A * | 3/1999 | Maeda | H01R 43/0486 | 29/705 |
| 6,513,695 | B2 * | 2/2003 | Yamakawa | B23K 20/02 | 228/115 |
| 8,407,885 | B2 * | 4/2013 | Dierks | G02B 6/3807 | 29/268 |

* cited by examiner

*Primary Examiner* — Lee D Wilson
*Assistant Examiner* — Seahee Yoon
(74) *Attorney, Agent, or Firm* — Cantor Colburn LLP

(57) ABSTRACT

The present disclosure relates generally to crimping tool for crimping a cup washer to a bolt. The crimping tool includes several alignment features that prevent the crimping tool from being used in an orientation other than a desired orientation.

20 Claims, 4 Drawing Sheets

CRIMPING TOOL

CROSS REFERENCE TO RELATED APPLICATION

This application claims the benefit of and incorporates by reference herein the disclosure of U.S. Ser. No. 61/915,866, filed Dec. 13, 2013.

TECHNICAL FIELD OF THE DISCLOSURE

The present disclosure is generally related to tools and, more specifically, to a crimping tool.

BACKGROUND OF THE DISCLOSURE

Cup washers are used in many applications to retain bolts in their assembled positions by means of applying crimps to the cup washer such that interference between the crimps and the bolt prevent rotation of the bolt. Such crimps are applied to the cup washers by means of a hammer and drift. Because the drift may be applied to the cup washer at any location desired by the user, it is not possible to ensure that the crimps will be applied to the cup washer at the desired location(s). Additionally, swinging of the hammer during the crimping process can result in errant hammer blows with possible injury to the operator using the hammer and to the surrounding hardware.

Accordingly, it is desirable to improve the performance of the cup washer crimping operation.

SUMMARY OF THE DISCLOSURE

In one embodiment, a crimping tool operative to crimp a cup washer to a bolt is disclosed, wherein the bolt includes a head, at least one tool engagement surface formed on the head and at least one depression formed around a perimeter of the bolt, wherein the cup washer includes a cup for receiving the head of the bolt, a rim disposed around a perimeter of the cup, and an opening formed in the cup and the rim, the crimping tool comprising: a crimp former, comprising: an interior space operative to receive the bolt head; an outer crimp former surface surrounding the interior space; at least one bolt engagement surface disposed at least partially within the interior space; a cup washer engagement surface extending from a distal end of the outer crimp former surface; at least one crimping tang extending distally a first distance from the cup washer engagement surface; a clocking body disposed on the outer crimp former surface; a clocking tab extending distally from the clocking body at least the first distance from the cup washer engagement surface; wherein engagement of the at least one bolt engagement surface with the at least one tool engagement surface of the bolt, and insertion of the clocking tab into the cup washer opening, is operative to position the at least one crimping tang at at least one desired location with respect to the at least one depression.

In another embodiment, a crimping tool operative to crimp a cup washer to a bolt is disclosed, wherein the bolt includes a head, at least one tool engagement surface formed on the head and at least one depression formed around a perimeter of the bolt, wherein the cup washer includes a cup for receiving the head of the bolt, a rim disposed around a perimeter of the cup, and an opening formed in the cup and the rim, the crimping tool comprising: a proximal end; a distal end; a handle disposed at the proximal end; a crimp former disposed at the distal end, the crimp former comprising: an interior space operative to receive the bolt head; an outer crimp former surface surrounding the interior space; at least one bolt engagement surface disposed at least partially within the interior space; a cup washer engagement surface extending from a distal end of the outer crimp former surface; at least one crimping tang extending distally a first distance from the cup washer engagement surface; a shaft operatively coupled to the handle and the crimp former; and a slide hammer in sliding engagement with the shaft; a clocking body disposed on the outer crimp former surface; a clocking tab extending distally from the clocking body at least the first distance from the cup washer engagement surface; wherein engagement of the at least one bolt engagement surface with the at least one tool engagement surface of the bolt, and insertion of the clocking tab into the cup washer opening, is operative to position the at least one crimping tang at at least one desired location with respect to the at least one depression.

In another embodiment, a crimping tool operative to crimp a cup washer to a bolt is disclosed, wherein the bolt includes a head, a plurality of tool engagement surfaces formed on the head and at least one depression formed around a perimeter of the bolt, wherein the cup washer includes a cup for receiving the head of the bolt, a rim disposed around a perimeter of the cup, an opening formed in the cup and the rim, and an anti-rotation tab operative to be disposed in an indentation in an adjacent component when the bolt and the cup washer are installed into the adjacent component, the crimping tool comprising: a proximal end; a distal end; a handle disposed at the proximal end; a handle flange disposed distal of the handle; a crimp former disposed at the distal end, the crimp former comprising: an interior space operative to receive the bolt head; an outer crimp former surface surrounding the interior space; at least one bolt engagement surface disposed at least partially within the interior space; a cup washer engagement surface extending from a distal end of the outer crimp former surface; an orientation tab extending distal of the cup washer engagement surface; at least one crimping tang extending distally a first distance from the cup washer engagement surface; a crimp former flange disposed proximal of the crimp former; a shaft operatively coupled to the handle and the crimp former; a slide hammer in sliding engagement with the shaft, the slide hammer including a proximal slide hammer flange and a distal slide hammer flange; a clocking body including a slot formed therethrough; a fastener extending through the clocking body slot, the fastener operative to attach the clocking body in sliding engagement with the outer crimp former surface; a clocking tab extending distally from the clocking body at least the first distance from the cup washer engagement surface; wherein engagement of the at least one bolt engagement surface and the orientation tab with the bolt, and insertion of the clocking tab into the cup washer opening, is operative to position the at least one crimping tang at at least one desired location with respect to the at least one depression.

Other embodiments are also disclosed.

BRIEF DESCRIPTION OF THE DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE DISCLOSED EMBODIMENTS

For the purposes of promoting an understanding of the principles of the invention, reference will now be made to certain embodiments and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates.

Figure 1:
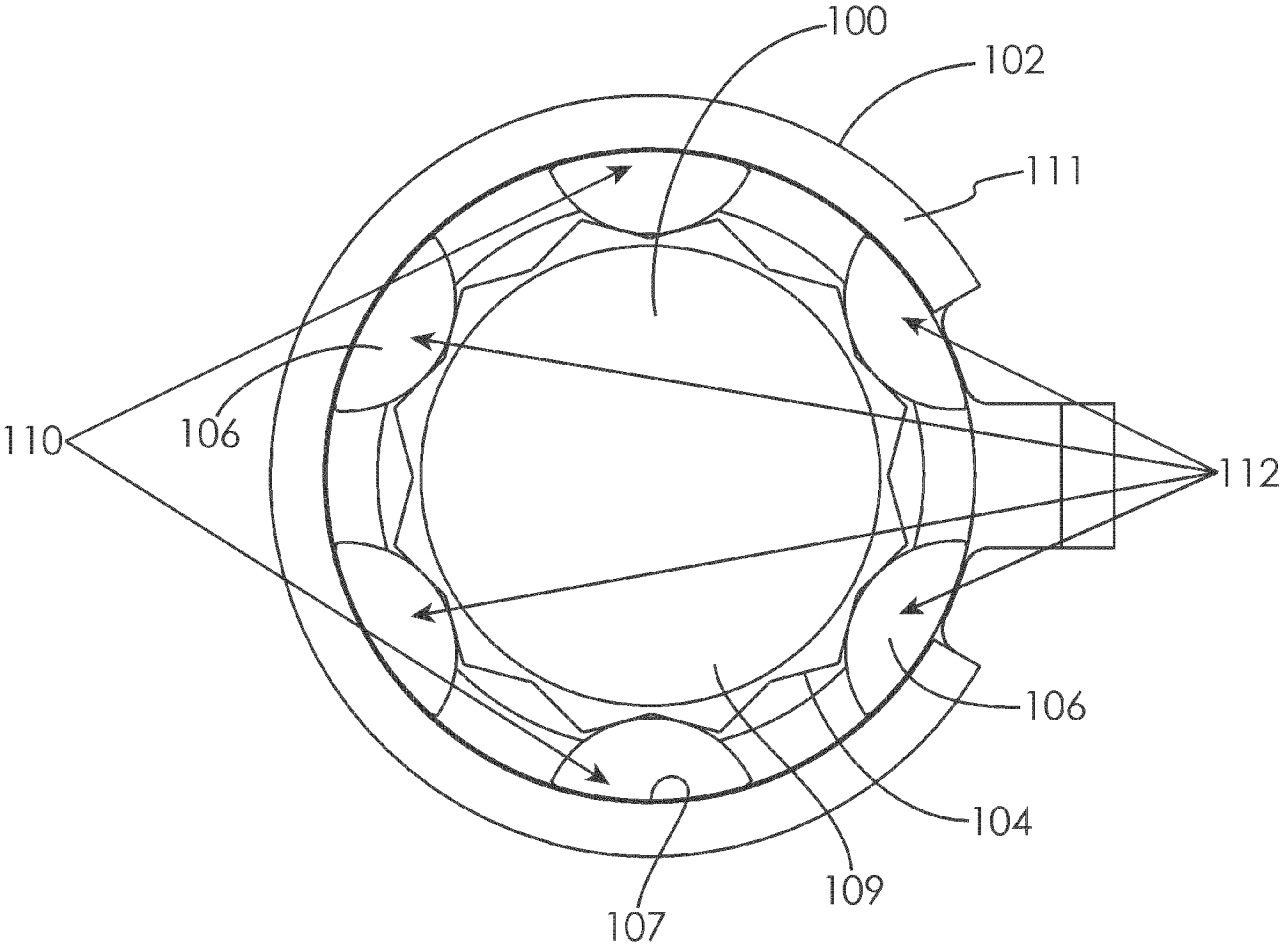
FIG. 1 is a schematic plan view of a bolt and a cup washer in an embodiment.

FIG. 1 schematically illustrates a bolt 100 and cup washer 102 in an embodiment. The bolt includes tool engagement surfaces 104 to which a tool (not shown) may apply forces causing the bolt 100 to be seated in its desired mounting location. The bolt 100 further includes a plurality of depressions 106 formed around a perimeter thereof. The cup washer 102 includes a cup 107 to receive a head 109 of the bolt 100. The cup 107 has a rim 111 formed around the cup 107. The cup washer 102 also includes an anti-rotation tab 108 that is disposed in a corresponding indentation in an adjacent component (not shown) when the bolt 100 and cup washer 102 are installed into the adjacent component. The cup washer 102 is crimped into the depressions 106 at two locations 110 such that material from the cup washer 102 will flow into the depressions 106 formed into the bolt 100 at the two locations 110. The combination of the crimps formed into the cup washer 102 at the locations 110 and the interaction of the anti-rotation tab 108 with the adjacent component prevent the bolt 100 from rotating in a direction that will cause the bolt 100 to loosen. It is desired to prevent crimps from being placed at the locations 112.

When an operator uses a hammer and drift to apply crimps to the cup washer 102, the location of where such crimps are placed is completely under the control of the operator. For a variety of reasons, some crimps placed by the operator using the hammer and drift may be placed in the locations 112 where crimps are not desired.

Figure 2:
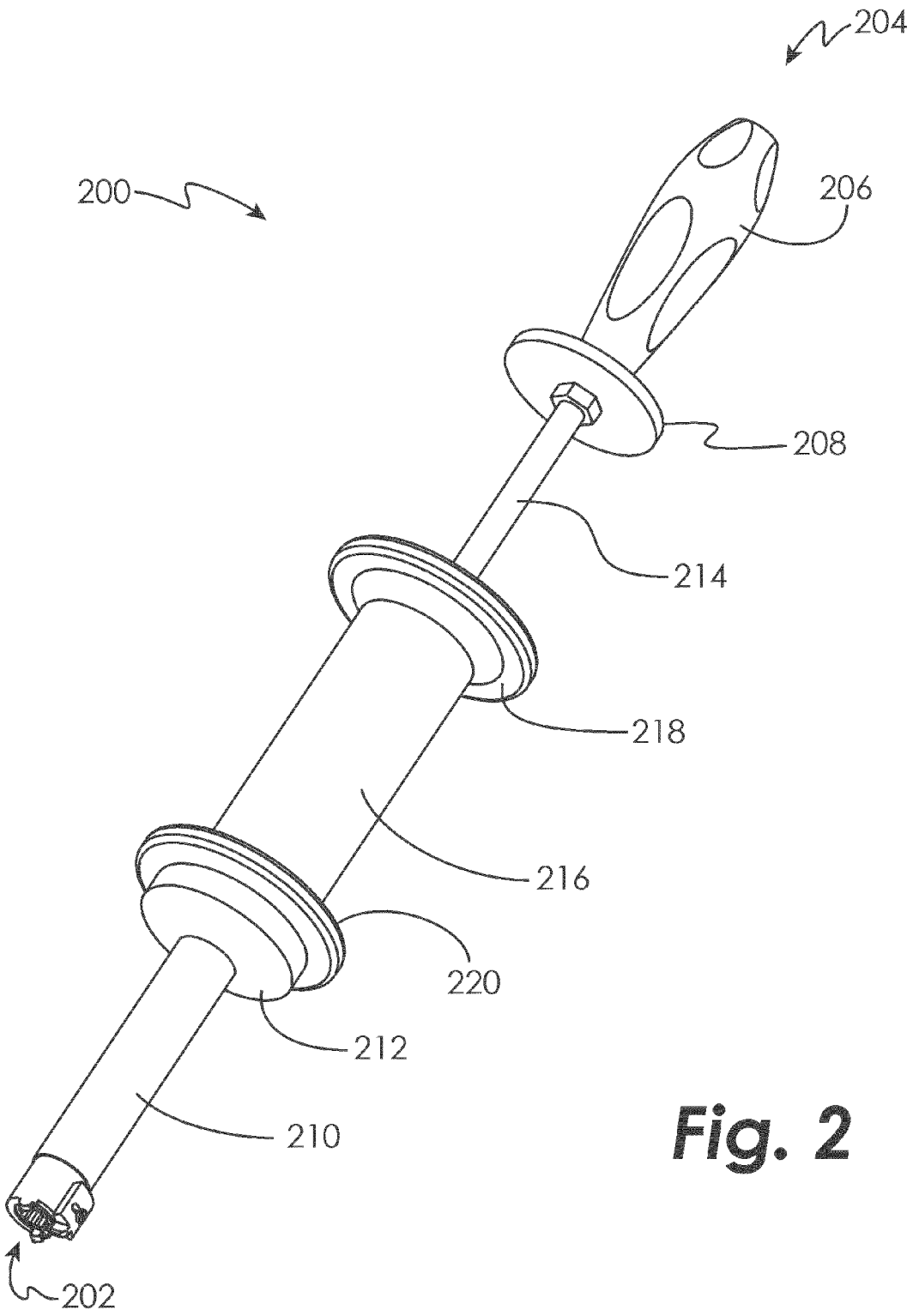
FIG. 2 is a schematic perspective view of a crimping tool in an embodiment.
Figure 3:
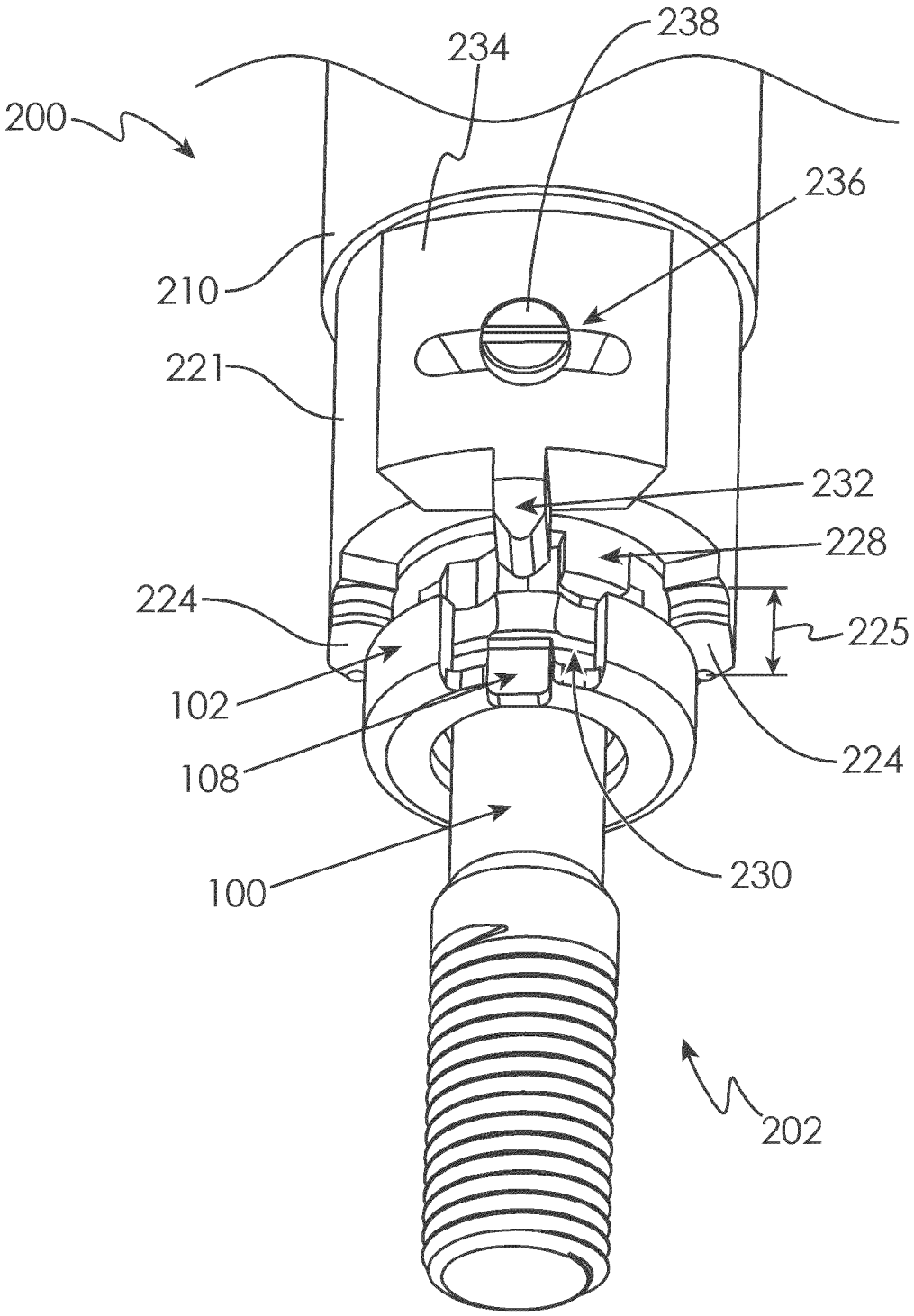
FIG. 3 is a schematic close-up view of a crimping tool applied to a bolt and cup washer in an embodiment.
Figure 4:
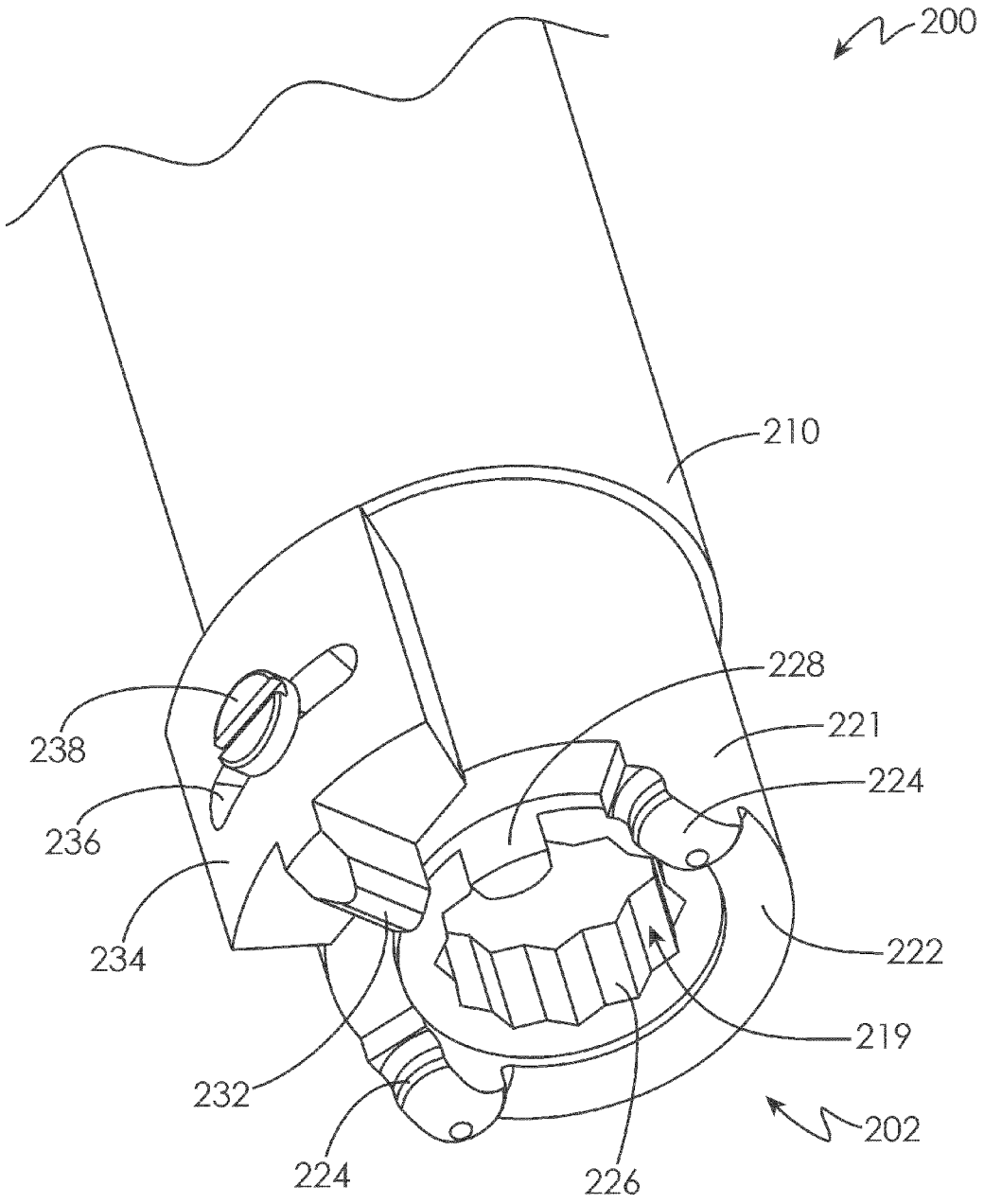
FIG. 4 is a schematic close-up view of a distal end of a crimping tool in an embodiment.

Referring now to FIGS. 2-4, there is shown a crimping tool 200 in an embodiment. The crimping tool 200 includes a distal end 202 and a proximal end 204. A handle 206 is provided at the proximal end 204 that may be gripped with one of the operator's hands. A handle flange 208 may be provided at a distal end of the handle 206. A crimp former 210 is provided at the distal end 202. The crimp former 210 may have a crimp former flange 212 at a proximal end thereof. The handle 206 and the crimp former 210 are coupled by a shaft 214. A slide hammer 216 is disposed around the shaft 214. The slide hammer 216 may be provided with a proximal slide hammer flange 218 and a distal slide hammer flange 220.

The crimp former 210 is formed as a hollow cylinder in an embodiment and includes an interior space 219, an outer crimp former surface 221 surrounding the interior space 219, a cup washer engagement surface 222 and at least one crimping tang 224 extending distally a first distance 225 from the cup washer engagement surface 222. The crimp former 210 further includes bolt engagement surfaces 226 configured to mate with tool engagement surfaces 104 of the bolt 100. The crimp former 210 further includes an orientation tab 228 that is configured to mate with one of the depressions 106 as described in greater detail hereinbelow. The orientation tab 228 extends distally further than the engagement surfaces 226 in an embodiment.

In order to prevent any of the crimping tangs 224 of the crimp former 210 from being placed into the opening 230 of the cup washer 102 where the anti-rotation tab 108 is located, a clocking tab 232 may be provided in an embodiment. The clocking tab extends distally at least the first distance 225 from the cup washer engagement surface 222 and is positioned at a circumferential position on the crimp former 210 that will cause it to engage the cup washer rim 111 if an attempt were made to place one of the crimping tangs 224 into the opening 230 of the cup washer 102. Such engagement of the cup washer rim 111 will prevent the crimping tang 224 from entering the opening 230 of the cup washer 102, thereby helping to ensure proper alignment of the crimping tangs 224 with the depressions 106 at the locations 110.

The clocking tab 232 is carried by a clocking body 234 having a slot 236 formed therethrough in an embodiment. The clocking body 234 is attached to the outer crimp former surface 221 by means of a fastener 238 extending through the slot 236 and into the clocking body 234. The fastener 238 comprises a bolt in an embodiment. The fastener 238 is positioned to allow the clocking body 234 to circumferentially slide around the outer crimp former surface 221 a distance permitted by the slot 236. Such sliding of the clocking body 234 allows the position of the clocking tab 232 to be adjusted to account for tolerance stack-ups in the bolt 100/cup washer 102/crimp former 210 combination.

When in use, the crimp former 210 is placed onto the cup washer 102, and the operator grips the handle 206 with one hand and the slide hammer 216 with the other hand. The slide hammer is raised proximally and then thrust distally until the distal slide hammer flange 220 strikes the crimp former flange 212. The handle flange 208 prevents the slide hammer 216 from striking the operator's hand that is gripping the handle 206. The force of the slide hammer flange 220 striking the crimp former flange 212 drives the crimping tangs 224 into the cup washer 102 rim 111, causing material from the cup washer 102 to be deformed into the depressions 106 at the locations 110. In other embodiments, the crimp former 210 does not include a slide hammer and is instead struck with a free swinging hammer or other tool. At full extension of the crimping tangs 224 into the cup washer 102 rim 111, the cup washer engagement surface 222 is in engagement with the cup washer 102 rim 111, thereby preventing over crimping by preventing further distal movement of the crimping tangs into the cup washer 102. This will prevent damage to the cup washer 102 and possible collateral damage to the surrounding hardware into which the bolt 100/cup washer 102 are installed.

The various features of the crimping tool 200 ensure that the crimping tangs 224 may only form crimps at the desired location(s) 110. As the crimp former 210 is placed over the bolt 100/cup washer 102 combination, the clocking tab 232 will engage the cup washer 102 rim 111 preventing further distal movement if the crimp former 210 is not properly aligned with the cup washer 102. If the crimp former 210 is properly aligned with the cup washer 102, the clocking tab 232 will enter the opening 230 of the cup washer 102, allowing the crimping tangs 224 to begin to engage the cup washer 102. The crimping tool 200 may be fully seated on the bolt 100/cup washer 102 by slight rotation thereof until the orientation tab 228 seats in a depression 106 and the bolt engagement surfaces 226 engage the tool engagement surfaces 104 of the bolt 100. In this position, where the bolt engagement surfaces 226 engage the tool engagement surfaces 104 of the bolt 100, the orientation tab 228 seats in a depression 106, and the clocking tab 232 is positioned in the opening 230 of the cup washer 102, the crimping tangs 224 are ensured to be aligned with the depressions 106 at the locations 110. Striking the slide hammer 216 against the crimp former 210 will therefore cause the cup washer 102 to be crimped onto the bolt 100 at the desired locations. It will be appreciated that the alignment features discussed hereinabove prevent use of the crimping tool 200 in any orientation other than the desired orientation.

While the invention has been illustrated and described in detail in the drawings and foregoing description, the same is to be considered as illustrative and not restrictive in character, it being understood that only certain embodiments have been shown and described and that all changes and modifications that come within the spirit of the invention are desired to be protected.

What is claimed:

1. A crimping tool operative to crimp a cup washer to a bolt, wherein the bolt includes a head, at least one tool engagement surface formed on the head and at least one depression formed around a perimeter of the bolt, wherein the cup washer includes a cup for receiving the head of the bolt, a rim disposed around a perimeter of the cup, and an opening formed in the cup and the rim, the crimping tool comprising:

a crimp former, comprising:

an interior space operative to receive the bolt head;

an outer crimp former surface surrounding the interior space;

at least one bolt engagement surface disposed at least partially within the interior space;

a cup washer engagement surface extending from a distal end of the outer crimp former surface;

at least one crimping tang extending distally a first distance from the cup washer engagement surface;

a clocking body disposed on the outer crimp former surface;

a clocking tab extending distally from the clocking body at least the first distance from the cup washer engagement surface;

wherein engagement of the at least one bolt engagement surface with the at least one tool engagement surface of the bolt, and insertion of the clocking tab into the cup washer opening, is operative to position the at least one crimping tang at at least one desired location with respect to the at least one depression.

2. The crimping tool of claim 1, further comprising:

a proximal end;

a distal end;

a handle disposed at the proximal end; and a handle flange disposed distal of the handle.

3. The crimping tool of claim 2, wherein the crimp former is disposed at the distal end.

4. The crimping tool of claim 2, further comprising:

a shaft operatively coupled to the handle and the crimp former; and a slide hammer in sliding engagement with the shaft, the slide hammer including a proximal slide hammer flange and a distal slide hammer flange.

5. The crimping tool of claim 4, wherein the slide hammer is disposed around the shaft.

6. The crimping tool of claim 1, further comprising a crimp former flange disposed proximal of the crimp former.

7. The crimping tool of claim 1, further comprising an orientation tab extending distal of the cup washer engagement surface.

8. The crimping tool of claim 7, wherein:

the orientation tab is operative to engage at least one of the at least one depression; and engagement of the at least one bolt engagement surface and the orientation tab with the bolt, and insertion of the clocking tab into the cup washer opening, is operative to position the at least one crimping tang at at least one desired location with respect to the at least one depression.

9. The crimping tool of claim 1, further comprising:

a slot formed through the clocking body; and a fastener extending through the clocking body slot, the fastener operative to attach the clocking body in sliding engagement with the outer crimp former surface.

10. The crimping tool of claim 9, wherein the fastener comprises a bolt.

11. The crimping tool of claim 9, wherein the fastener allows the clocking body to circumferentially slide around the outer crimp former surface a second distance permitted by the clocking body slot.

12. The crimping tool of claim 11, wherein the second distance permits a position of the clocking tab with respect to the outer crimp former surface to be adjusted to account for tolerance stack-ups in the bolt, cup washer, and crimp former combination.

13. The crimping tool of claim 1, wherein the clocking tab is positioned circumferentially on the outer crimp former surface such that the clocking tab will engage the cup washer rim if an attempt is made to place one of the at least one crimping tangs into the cup washer opening.

14. A crimping tool operative to crimp a cup washer to a bolt, wherein the bolt includes a head, at least one tool engagement surface formed on the head and at least one depression formed around a perimeter of the bolt, wherein the cup washer includes a cup for receiving the head of the bolt, a rim disposed around a perimeter of the cup, and an opening formed in the cup and the rim, the crimping tool comprising:

a proximal end;

a distal end;

a handle disposed at the proximal end;

a crimp former disposed at the distal end, the crimp former comprising:

an interior space operative to receive the bolt head;

an outer crimp former surface surrounding the interior space;

at least one bolt engagement surface disposed at least partially within the interior space;

a cup washer engagement surface extending from a distal end of the outer crimp former surface;

at least one crimping tang extending distally a first distance from the cup washer engagement surface;

a shaft operatively coupled to the handle and the crimp former; and a slide hammer in sliding engagement with the shaft;

a clocking body disposed on the outer crimp former surface;

a clocking tab extending distally from the clocking body at least the first distance from the cup washer engagement surface;

wherein engagement of the at least one bolt engagement surface with the at least one tool engagement surface of the bolt, and insertion of the clocking tab into the cup washer opening, is operative to position the at least one crimping tang at at least one desired location with respect to the at least one depression.

15. The crimping tool of claim 14, wherein the slide hammer is disposed around the shaft.

16. The crimping tool of claim 14, further comprising an orientation tab extending distal of the cup washer engagement surface.

17. The crimping tool of claim 16, wherein:

the orientation tab is operative to engage at least one of the at least one depression; and engagement of the at least one bolt engagement surface and the orientation tab with the bolt, and insertion of the clocking tab into the cup washer opening, is operative to position the at least one crimping tang at at least one desired location with respect to the at least one depression.

18. The crimping tool of claim 14, further comprising:

a slot formed through the clocking body; and a fastener extending through the clocking body slot, the fastener operative to attach the clocking body in sliding engagement with the outer crimp former surface.

19. The crimping tool of claim 18, wherein:

the fastener allows the clocking body to circumferentially slide around the outer crimp former surface a second distance permitted by the clocking body slot;

the second distance permits a position of the clocking tab with respect to the outer crimp former surface to be adjusted to account for tolerance stack-ups in the bolt, cup washer, and crimp former combination; and the clocking tab is positioned circumferentially on the outer crimp former surface such that the clocking tab will engage the cup washer rim if an attempt is made to place one of the at least one crimping tangs into the cup washer opening.

20. A crimping tool operative to crimp a cup washer to a bolt, wherein the bolt includes a head, a plurality of tool engagement surfaces formed on the head and at least one depression formed around a perimeter of the bolt, wherein the cup washer includes a cup for receiving the head of the bolt, a rim disposed around a perimeter of the cup, an opening formed in the cup and the rim, and an anti-rotation tab operative to be disposed in an indentation in an adjacent component when the bolt and the cup washer are installed into the adjacent component, the crimping tool comprising:

a proximal end;

a distal end;

a handle disposed at the proximal end;

a handle flange disposed distal of the handle;

a crimp former disposed at the distal end, the crimp former comprising:

an interior space operative to receive the bolt head;

an outer crimp former surface surrounding the interior space;

at least one bolt engagement surface disposed at least partially within the interior space;

a cup washer engagement surface extending from a distal end of the outer crimp former surface;

an orientation tab extending distal of the cup washer engagement surface;

at least one crimping tang extending distally a first distance from the cup washer engagement surface;

a crimp former flange disposed proximal of the crimp former;

a shaft operatively coupled to the handle and the crimp former;

a slide hammer in sliding engagement with the shaft, the slide hammer including a proximal slide hammer flange and a distal slide hammer flange;

a clocking body including a slot formed therethrough;

a fastener extending through the clocking body slot, the fastener operative to attach the clocking body in sliding engagement with the outer crimp former surface;

a clocking tab extending distally from the clocking body at least the first distance from the cup washer engagement surface;

wherein engagement of the at least one bolt engagement surface and the orientation tab with the bolt, and insertion of the clocking tab into the cup washer opening, is operative to position the at least one crimping tang at at least one desired location with respect to the at least one depression.

* * * * *